United States Patent [19]

Paul

[11] 4,041,887

[45] Aug. 16, 1977

[54] DOCKING APPARATUS FOR BOATS

[76] Inventor: William A. Paul, 1808 Parkside Blvd., Toledo, Ohio 43607

[21] Appl. No.: 695,660

[22] Filed: June 14, 1976

[51] Int. Cl.[2] ..... B63B 21/00

[52] U.S. Cl. ..... 114/230

[58] Field of Search ..... 114/230, 231, 218, 221 R, 114/235 B; 9/8 P

[56] References Cited

U.S. PATENT DOCUMENTS

| | | | |
|---|---|---|---|
| 3,134,154 | 5/1964 | Smith et al. | 114/230 X |
| 3,151,595 | 10/1964 | Stainbrook | 114/230 |
| 3,467,046 | 9/1969 | Welton | 114/230 |

*Primary Examiner*—Stephen G. Kunin
*Assistant Examiner*—Gregory W. O'Connor
*Attorney, Agent, or Firm*—Allen D. Gutchess, Jr.

[57] ABSTRACT

A docking device is provided for aiding in the docking or mooring of a boat. The device is particularly advantageous for pleasure boats which may have but one pilot or operator but which normally require more than one person to dock the boat. The docking device includes a dock post or mooring post around which a line is positioned. The portion of the line on the side of the post from which the boat approaches is held extended from the post by supporting arms. The arms are pivotally attached to the post and swing downwardly to lower the line when the operator has maneuvered the boat such that a cleat thereon is adjacent the post and under the line. A remotely-controlled element holds the arms in the extended position and, when operated by a signal from the boat, enables the arms to swing downwardly and place the line around the cleat. With the line then encircling the cleat, the pilot can maneuver the boat to cause the cleat to move the line in a manner to strip it from the arms and thereby leave the boat connected to the post through the line and the cleat.

7 Claims, 4 Drawing Figures

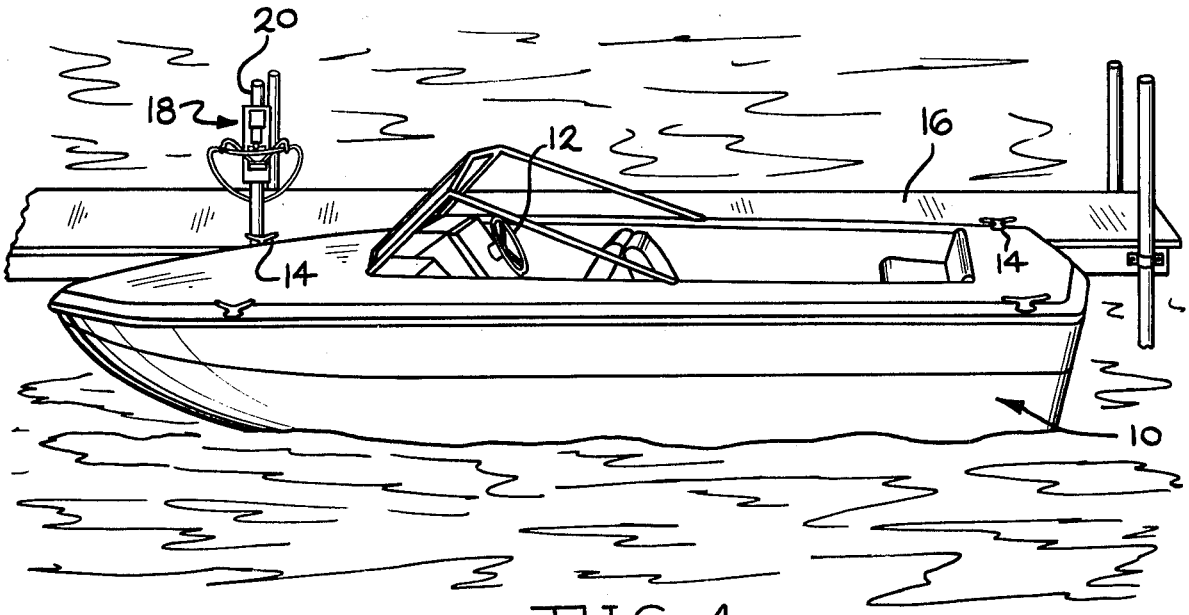
FIG. 1
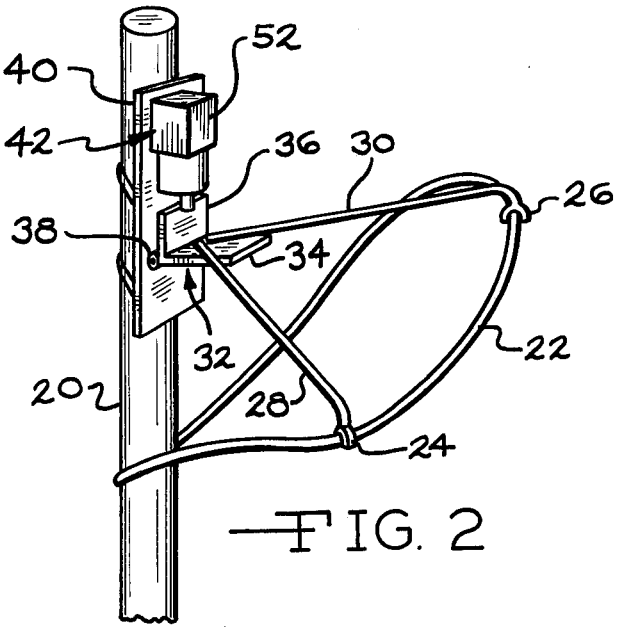
FIG. 2
FIG. 3
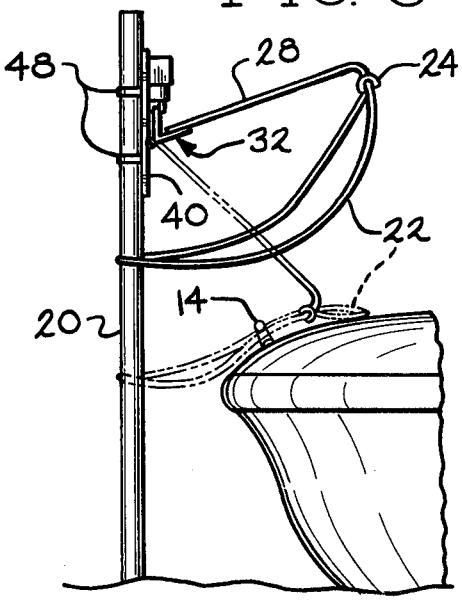
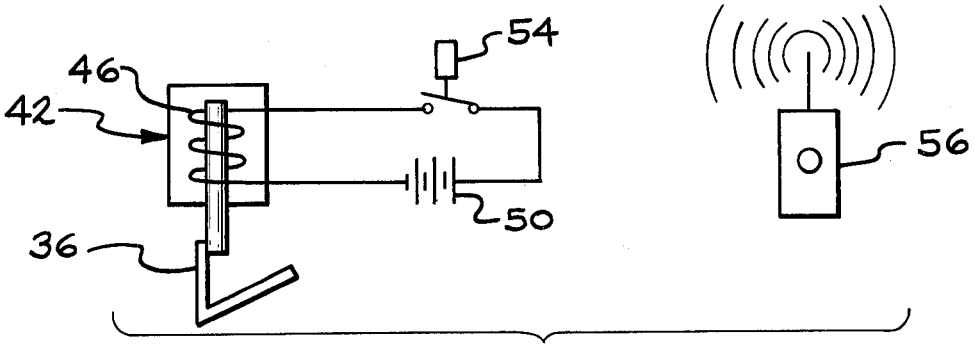
FIG. 4

DOCKING APPARATUS FOR BOATS

This invention relates to a device for aiding in the mooring or docking of a boat.

Many boats, except for small rowboats, can be rather difficult to dock by one person, especially under adverse conditions, such as wind and waves. The operator frequently must leave the steering wheel or the outboard motor handle to be able to reach over to the dock or mooring post in order to secure a line thereto. In doing so, the operator also relinquishes control of the boat. As a consequence, it is not uncommon for the boat to drift or blow away from the dock before a tie-up can be made.

The present invention provides a docking device which enables the operator to secure a line from the dock post or mooring post to the boat from a control position in the boat without having to leave the controls. The docking device includes a post around which a line is located and which is held in a raised position above the boat deck by a pair of arms. The arms can be released by remote control at the boat to enable them to swing down and carry the line downwardly around a cleat or other suitable projection extending upwardly from the boat. A connection is thereby automatically made between the post and the boat. At this time, the operator can maneuver the boat slightly to engage the line by the cleat and, at the same time, strip the line from the arms which had held it, if desired. The operator, having a connection between the post or dock and the boat, can then secure the boat with additional lines, as required.

It is, therefore, a principal object of the invention to provide apparatus for facilitating the docking of a boat.

Another object of the invention is to enable a boat to be docked more easily by a single operator.

Many other objects and advantages to the invention will be apparent from the following detailed description of a preferred embodiment thereof, reference being made to the accompanying drawing, in which:

FIG. 1 is a view in perspective of a boat and a dock having a post carrying a docking or mooring device according to the invention;

FIG. 2 is a view in perspective of the post and docking device of FIG. 1;

FIG. 3 is a side view in elevation of the post and docking device, with portions of the device also shown in dotted lines in a second position; and FIG. 4 is a diagrammatic view of an electrical circuit for operating the docking device.

Referring to the drawings, and particularly to FIG. 1, a boat usable with the invention is indicated at 10 and is shown as an inboard or inboard-outboard type with a steering wheel 12 from which the boat can be steered and operated. The boat has line-engaging members in the form of cleats 14 by means of which the boat can be tied to a dock 16.

A docking or mooring device 18 according to the invention is mounted on a fixed upright member in the form of a dock post or mooring post 20. The docking device 18, as shown in FIGS. 2 and 3 in particular, includes a suitable flexible mooring line 22 which, in a preferred form, encircles the post 20. The line 22 is held in a raised position by fingers 24 and 26 at the extremities of arms 28 and 30. The fingers and the arms are of a resilient or spring wire metal and covered by rubber or other suitable material to avoid damage to the boat. As shown, the arms 28 and 30 are suitably affixed, as by welds, to a generally L-shape bracket 32 having a generally horizontally-extending leg 34 and vertically-extending leg 36. At the juncture of the legs 34 and 36 is a hinge 38 which pivotally connects the bracket 32 to a mounting board 40.

A releasing device in the form of an electrically-operated solenoid 42 is located above the bracket 32 and has a core 44 normally extending downwardly in front of the leg 36 of the bracket 32. When a coil 46 of the solenoid is energized, the core 44 is retracted or raised to clear the upper edge of the vertical leg 36 of the bracket. The bracket 32 and the arms 28 and 30 can then swing downwardly by gravity to move the outward extremity of the line 22 to the boat deck with the cleat 14 being between the extremity of the rope and the dock post 20. The boat can then be maneuvered by the pilot or operator, if desired, to engage the cleat 14 with a portion of the line 22 and to strip the line from the fingers 24 and 26 of the arms 28 and 30. Otherwise, the operator can simply tighten the rope after he steps onto the dock or use another mooring rope, and he also can then secure another suitable line to the rear cleat 14, if desired.

The mounting board 40 can be suitably affixed to the posts 20 at a desired position by straps 48. The docking device 18 is preferably vertically positioned so that the line 22 will be somewhat above the highest position of the cleat 14 when the boat approaches the dock. This position should be sufficiently high to assure that the arms will not touch the boat prior to dropping the line due to wave action, tides, etc.

In order to operate the solenoid 42, a battery 50 can be located in a housing 52 above the solenoid 42. This housing can also include a suitable remotely-controlled switch 54 which can be actuated when subjected to waves of a transmitter 56. The transmitter 56 can transmit radio waves or sound waves, if of the tuning-fork type, with the switch 54 then actuated and closed when receiving the waves. Both the switch 54 and the transmitter 56 are commercially available and can be of the types used in garage door openers.

From the above, then, it will be seen that the boat 10 can be easily docked or connected to the dock 16 simply by the operator maneuvering the boat so that the cleat 14 is under the line 22, at which time he activates the transmitter 56 to release the arms 28 and 30 and enable the line to drop around the cleat 14.

Various modifications of the above-described embodiment of the invention will be apparent to those skilled in the art, and it is to be understood that such modifications can be made without departing from the scope of the invention, if they are within the spirit and the tenor of the accompanying claims.

I claim:

1. Apparatus for aiding in connecting a boat to a fixed upright member, said apparatus including, in combination, a boat having a line-engagable member thereon, a fixed upright member, a flexible line engaged with said upright member, holding means comprising at least one arm having one end movably supported on said upright member on the side of said upright member toward which the boat will approach with the other end of said arm having means for engaging said flexible line for holding a portion of said line above the level of said line-engagable member on the boat, at least the other end of said arm being movable in a vertical direction to move the portion of said line toward said line-engagable member, and means engagable with said arm and operable from the boat for actuating said holding means to drop said line around said line-engagable member, said operable means including means for enabling said arm to move downwardly to move said line toward engagement with said line-engagable member on the boat.

2. Apparatus according to claim 1 characterized by said holding means comprising an arm pivotally supported on said upright member and said operable means comprising a solenoid with a core having a first position for holding said arm extending transversely from said upright member and a second position enabling said arm to freely pivot downwardly toward said line-engagable member.

3. Apparatus according to claim 2 characterized by means including transmitter means for operating said solenoid to move said core from the first position to the second position.

4. Apparatus according to claim 3 characterized by a mounting board affixed to said upright member, said arm being pivotally supported on said upright member by a bracket hingedly mounted on said board, said solenoid also being mounted on said board.

5. Apparatus for aiding in connecting a cleat of a boat to a fixed upright member, said apparatus comprising mounting means to be affixed in a given position on said upright member, a flexible line for connecting the cleat and the upright member, holding means comprising at least one arm having one end pivotally supported on said mounting means and the other end having means for engaging said line for holding a portion of said line above the level of the cleat of the boat, said line also encircling said upright member, and means mounted on said mounting means and remotely operable from the boat for enabling said holding means to drop a portion of said line around the cleat, said operable means including means for enabling said arm to pivot downwardly to move said line toward engagement with the cleat.

6. Apparatus according to claim 5 characterized by said holding means comprising an arm, and said operable means comprising a solenoid with a core having a first position for holding said arm extending transversely from said upright member and a second position enabling said arm to pivot downwardly toward the cleat.

7. Apparatus according to claim 6 characterized by means including transmitter means for operating said solenoid to move said core from the first position to the second position.

* * * * *